US007170451B2

(12) United States Patent
Hsu

(10) Patent No.: US 7,170,451 B2
(45) Date of Patent: Jan. 30, 2007

(54) ANTENNA DEVICE HAVING ULTRA WIDE BANDWIDTH CHARACTERISTICS

(75) Inventor: Fideric Hsu, Taipei (TW)

(73) Assignee: Universal Scientific Industrial Co., Ltd. (TW)

( * ) Notice: Subject to any disclaimer, the term of this patent is extended or adjusted under 35 U.S.C. 154(b) by 42 days.

(21) Appl. No.: 11/184,148

(22) Filed: Jul. 19, 2005

(65) Prior Publication Data

US 2006/0232487 A1 Oct. 19, 2006

(51) Int. Cl.
*H01Q 1/38* (2006.01)
*H01Q 13/10* (2006.01)

(52) U.S. Cl. ..... 343/700 MS; 343/770

(58) Field of Classification Search ..... 343/700 MS, 343/767, 770, 846
See application file for complete search history.

(56) References Cited

U.S. PATENT DOCUMENTS 6,429,819 B1 * 8/2002 Bishop et al. ..... 343/725
6,590,545 B2 7/2003 McCorkle
7,050,013 B2 * 5/2006 Kim et al. ..... 343/770
7,109,926 B2 * 9/2006 du Toit ..... 343/700 MS

* cited by examiner

*Primary Examiner*—Shih-Chao Chen
(74) *Attorney, Agent, or Firm*—Caesar, Rivise, Bernstein, Cohen & Pokotilow, Ltd.

(57) ABSTRACT

An antenna device having ultra wide bandwidth characteristics includes: a dielectric substrate having first and second surfaces that are opposite to each other in a normal direction; a radiating element formed on the first surface of the dielectric substrate and defining an axis perpendicular to the normal direction; and a grounding element formed on the second surface of the dielectric substrate and cooperating with the radiating element to define first and second imaginary slots in the dielectric substrate. The first and second imaginary slots extend in the normal direction from the first surface to the second surface of the dielectric substrate, and are respectively disposed at two opposite sides of the axis.

14 Claims, 8 Drawing Sheets

ANTENNA DEVICE HAVING ULTRA WIDE BANDWIDTH CHARACTERISTICS

BACKGROUND OF THE INVENTION

1. Field of the Invention

This invention relates to an antenna device, more particularly to an ultra wide bandwidth (UWB) antenna device formed with imaginary slots in a dielectric substrate thereof.

2. Description of the Related Art

Use of ultra wide bandwidth (UWB) in wireless personal area network (WPAN) is the current trend. FIGS. 1 and 2 respectively illustrate a conventional inverted-F antenna 1 and a conventional slot antenna 2, which cannot be operated at the UWB range. FIG. 3 illustrates another conventional antenna that includes a radiating element 11 and a ground element 12, and that can be operated at the UWB range. The conventional UWB antenna is disadvantageous in that the radiating element 11 is perpendicular to the ground element 12 and that the area of the ground element 12 (10 cm×10 cm) is relatively large. As such, it is relatively difficult and inconvenient to integrate the conventional UWB antenna into a circuit board.

There is a need to provide an antenna that is capable of operating at the UWB range, that can be easily manufactured, and that can be miniaturized.

SUMMARY OF THE INVENTION

The object of the present invention is to provide an antenna device with two imaginary slots that is capable of overcoming the aforesaid drawbacks of the aforesaid conventional antenna device.

According to the present invention, there is provided an antenna device having ultra wide bandwidth (UWB) characteristics. The antenna device comprises: a dielectric substrate having first and second surfaces that are opposite to each other in a normal direction; a radiating element formed on the first surface of the dielectric substrate, defining an axis perpendicular to the normal direction, and having a peripheral edge that has an inner portion; and a grounding element formed on the second surface of the dielectric substrate and having a peripheral edge that has an inner portion facing toward the inner portion of the peripheral edge of the radiating element. The inner portion of the peripheral edge of the grounding element cooperates with the inner portion of the peripheral edge of the radiating element to define first and second imaginary slots in the dielectric substrate. The first and second imaginary slots extend in the normal direction from the first surface to the second surface of the dielectric substrate, and are respectively disposed at two opposite sides of the axis.

BRIEF DESCRIPTION OF THE DRAWINGS

In drawings which illustrate embodiments of the invention.

DETAILED DESCRIPTION OF THE PREFERRED EMBODIMENTS

Figure 1:
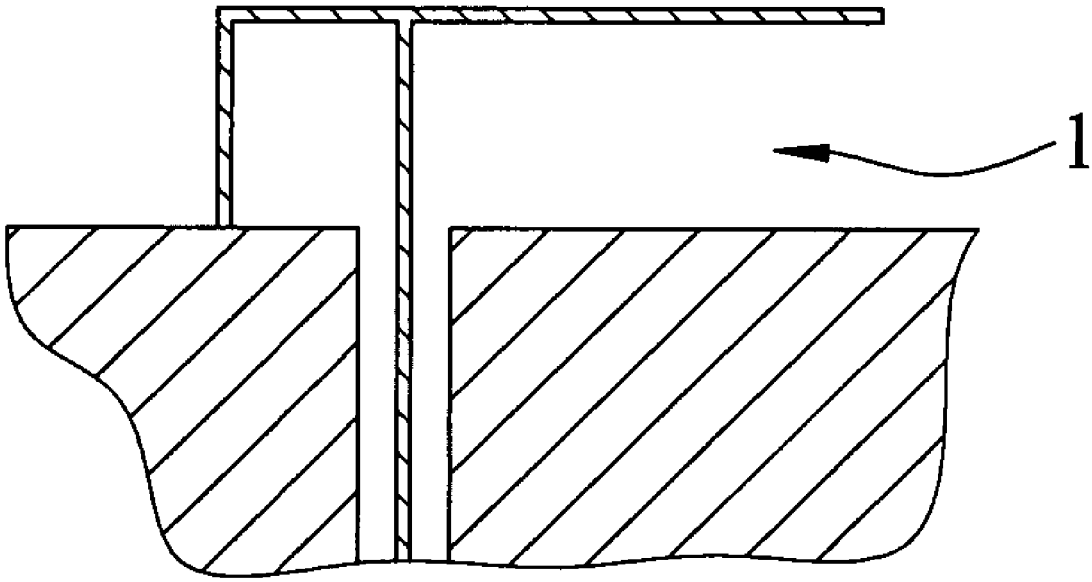
FIG. 1 PRIOR ART
FIG. 1 is a fragmentary sectional view of a conventional inverted-F antenna.
Figure 2:
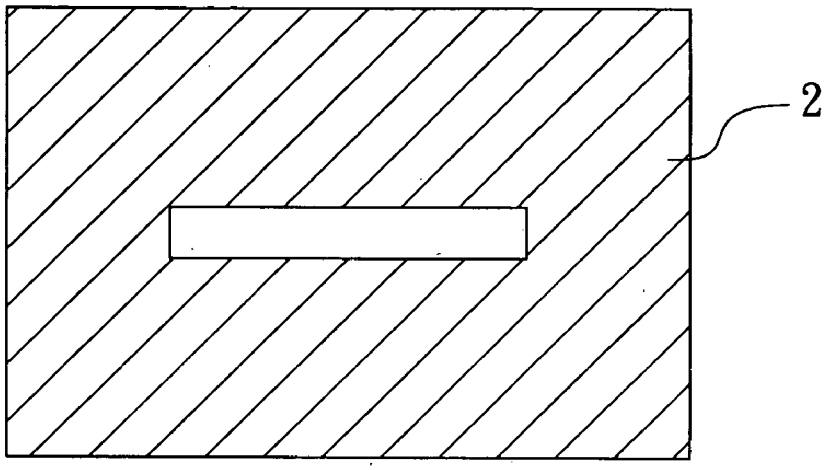
FIG. 2 PRIOR ART
FIG. 2 is a schematic sectional view of a conventional slot antenna.
Figure 3:
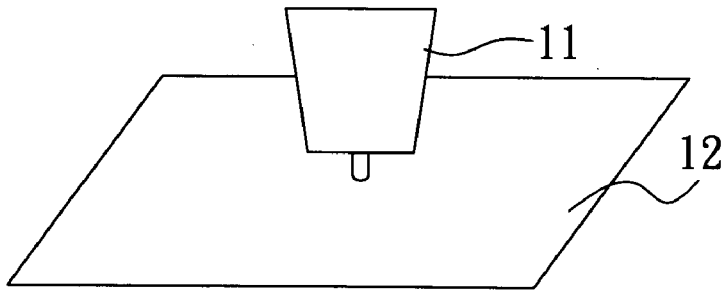
FIG. 3 PRIOR ART
FIG. 3 is a schematic view of a conventional UWB antenna.

Before the present invention is described in greater detail, it should be noted that same reference numerals have been used to denote like elements throughout the specification.

Figure 4:
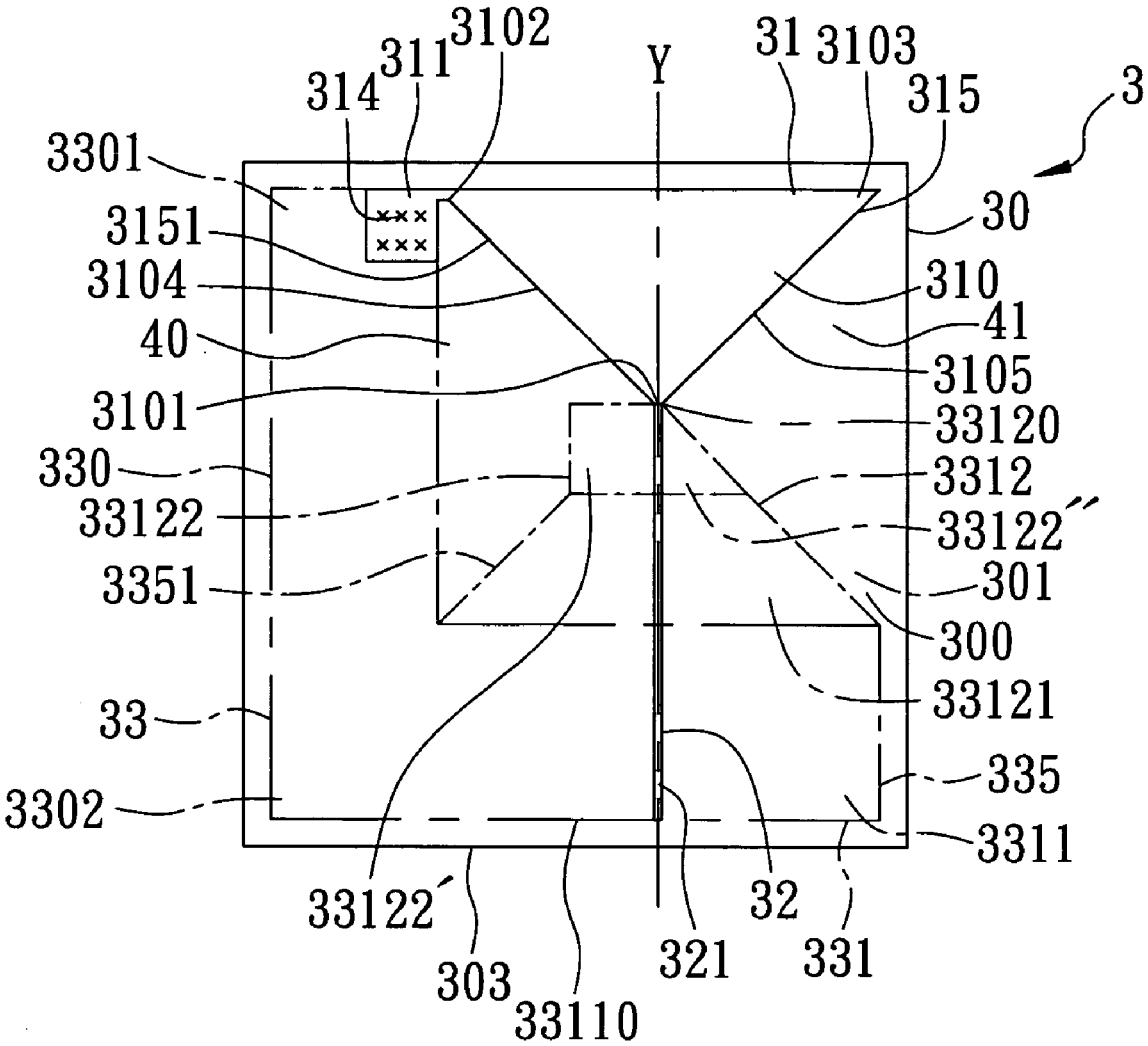
FIG. 4 is a fragmentary schematic view of the first preferred embodiment of an antenna device according to this invention.

FIG. 4 illustrates the first preferred embodiment of a planar antenna device 3 having ultra wide bandwidth (UWB) characteristics according to this invention.

The planar antenna device 3 includes: a dielectric substrate 30 having first and second surfaces 300, 301 that are opposite to each other in a normal direction; a radiating element 31 formed on the first surface 300 of the dielectric substrate 30, defining an axis (Y) perpendicular to the normal direction, and having a peripheral edge 315 that has an inner portion 3151; and a grounding element 33 formed on the second surface 301 of the dielectric substrate 30 and having a peripheral edge 335 that has an inner portion 3351 facing toward the inner portion 3151 of the peripheral edge 315 of the radiating element 31. The inner portion 3351 of the peripheral edge 335 of the grounding element 33 cooperates with the inner portion 3151 of the peripheral edge 315 of the radiating element 31 to define first and second imaginary slots 40, 41 in the dielectric substrate 30. The first and second imaginary slots 40, 41 extend in the normal direction from the first surface 300 to the second surface 301 of the dielectric substrate 30, and are respectively disposed at two opposite sides of the axis (Y).

In this embodiment, the radiating element 31 has a first part 310 that defines a first tip 3101 at the inner portion 3151 of the peripheral edge 315 of the radiating element 31. The axis (Y) passes through the first tip 3101. The first imaginary slot 40 diverges from the first tip 3101 in a first direction transverse to the axis (Y), whereas the second imaginary slot 41 diverges from the first tip 3101 in a second direction opposite to the first direction.

Preferably, the first part 310 of the radiating element 31 is substantially triangular in shape, and further defines a second tip 3102. The radiating element 31 further includes a second part 311 that is substantially square in shape and that extends from the second tip 3102 in a direction parallel to the axis (Y).

The first part 310 of the radiating element 31 further defines a third tip 3103, and has a first side 3104 extending between the first and second tips 3101, 3102 and confining one side of the first imaginary slot 40, and a second side 3105 extending between the first and third tips 3101, 3103 and confining one side of the second imaginary slot 41.

The grounding element 33 has a first part 330 that extends in a direction parallel to the axis (Y) and that has a first end portion 3301 aligned with the second part 311 of the radiating element 31 in the normal direction, and a second end portion 3302 opposite to the first end portion 3301. The grounding element 33 further includes a second part 331 that extends from the second end portion 3302 of the first part 330 of the grounding element 33 and that is aligned with the first part 310 of the radiating element 31 along the axis (Y).

Preferably, the second part 331 of the grounding element 33 has a first segment 3311 extending transversely from the second end portion 3302 of the first part 330 of the grounding element 33 and passing through the axis (Y), and a second segment 3312 reduced in dimension from the first segment 3311 toward the first tip 3101 of the first part 310 of the radiating element 31 and having an edge 33120 that is aligned with the first tip 3101 of the first part 310 of the radiating element 31 in the normal direction. The second segment 3312 of the second part 331 of the grounding element 33 cooperates with the first part 330 of the grounding element 33 and the first part 310 of the radiating element 31 to define the first imaginary slot 40, whereas the second segment 3312 of the second part 331 of the grounding element 33 cooperates with the first part 310 of the radiating element 31 to define the second imaginary slot 41.

Preferably, the second segment 3312 of the second part 331 of the grounding element 33 has a first section 33121 that is reduced in dimension from the first segment 3311 and that is trapezoid in shape, and a second section 33122 that extends from the first section 33121 and that defines the edge 33120 of the second segment 3312.

In this embodiment, the second section 33122 of the second segment 3312 has a first portion 33122' that is square in shape and that is disposed at one of the sides of the axis (Y), and a second portion 33122" that is triangular in shape and that is disposed at the other of the sides of the axis (Y).

A feeding element 32, which is in the form of a metal micro-strip, is formed on the first surface 300 of the dielectric substrate 30, and extends from the first tip 3101 of the radiating element 31 along the axis (Y). The first segment 3311 of the second part 331 of the grounding element 33 has an outer side 33110 that is distal from the second segment 3312 of the second part 331 of the grounding element 33. The feeding element 32 has a terminal end 321 that is aligned with the outer side 33110 of the first segment 3311 in the normal direction.

Preferably, the second part 311 of the radiating element 31 is formed with a plurality of through-holes. A plurality of conductive connecting lines 314 extend respectively through the through-holes in the second part 311 of the radiating element 31 to connect with the second part 311 of the radiating element 31, and extend through the dielectric substrate 30 to connect with the first end portion 3301 of the first part 330 of the grounding element 33.

Figure 5:
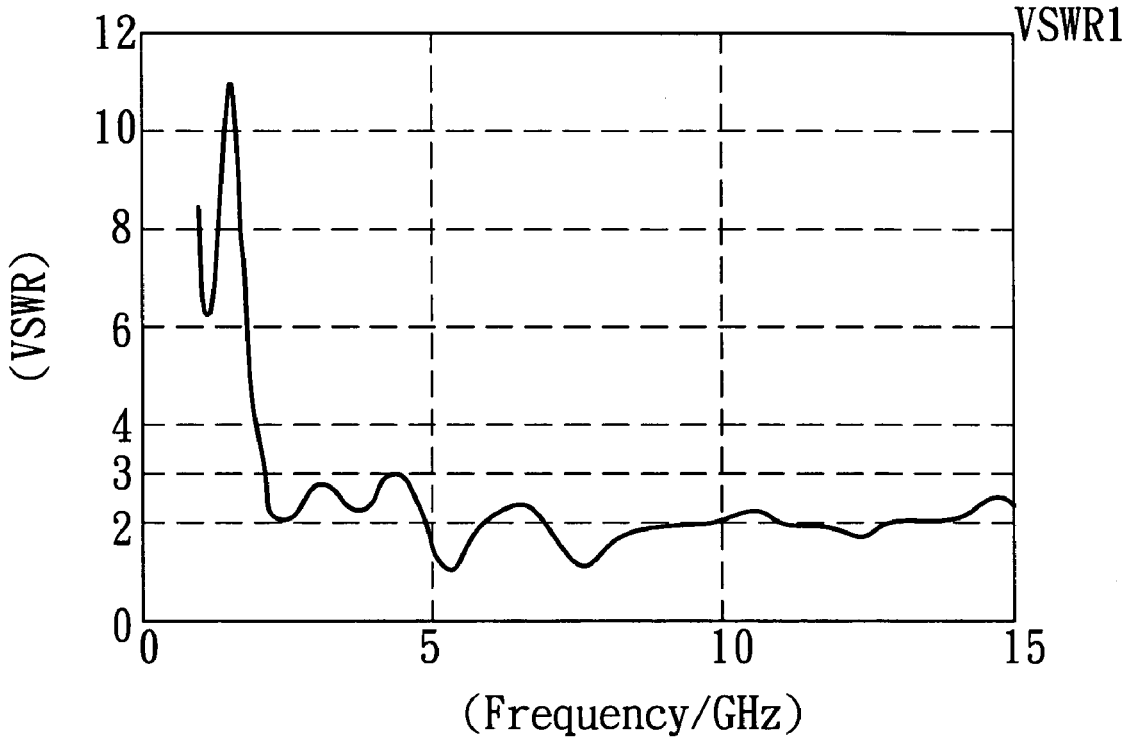
FIG. 5 is a plot of the voltage standing wave ratio (VSWR) of the first preferred embodiment within a range of frequency.

As illustrated in FIG. 5, the planar antenna device 3 thus formed has a low VSWR, i.e., below 3, within a frequency range from 3.1 GHz to 10.6 GHz, and is thus suitable for operating at the ultra wide bandwidth.

Figure 6:
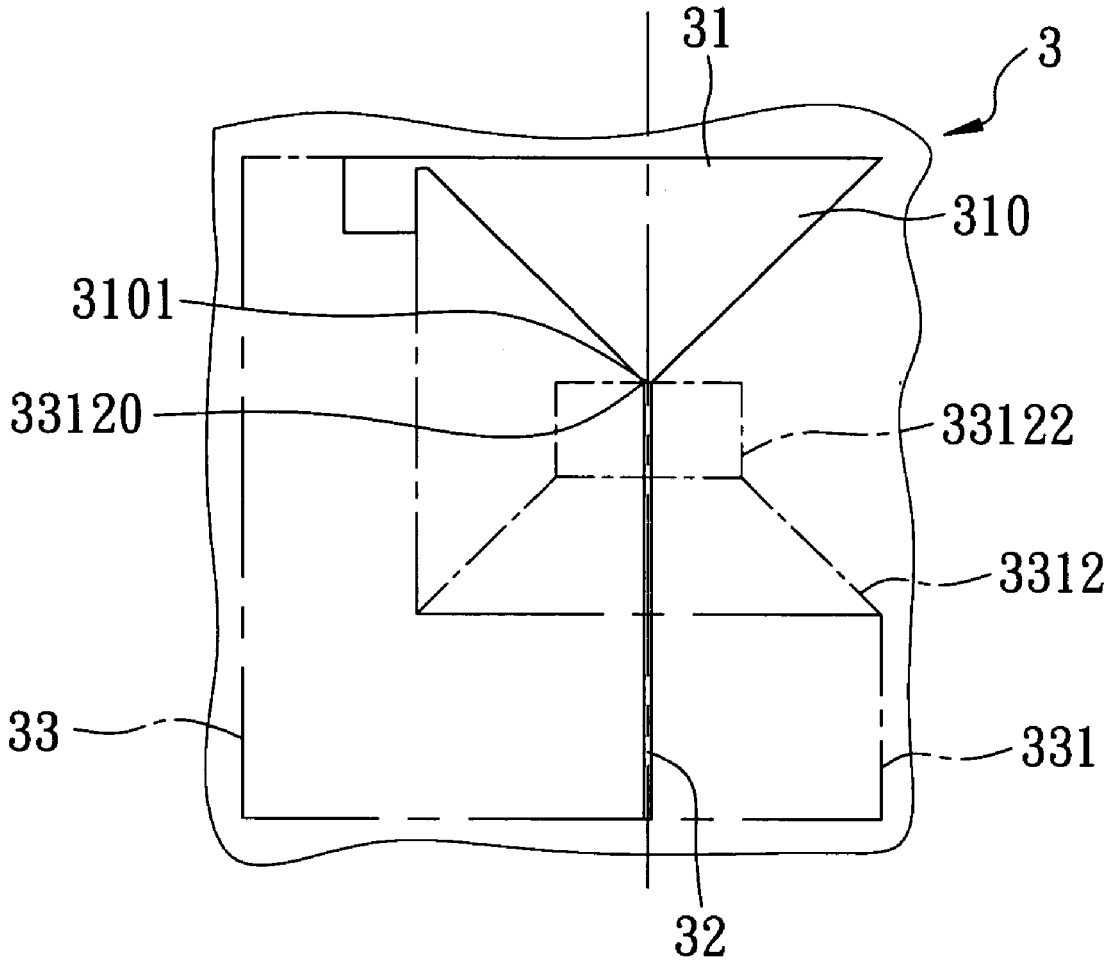
FIG. 6 is a fragmentary schematic view of the second preferred embodiment of an antenna device according to this invention.

FIG. 6 illustrates the second preferred embodiment of the planar antenna device 3 according to this invention. The planar antenna device 3 of this embodiment differs from the previous embodiment in that the second section 33122 of the second segment 3312 is rectangular in shape, and passes through the axis (Y).

Figure 7:
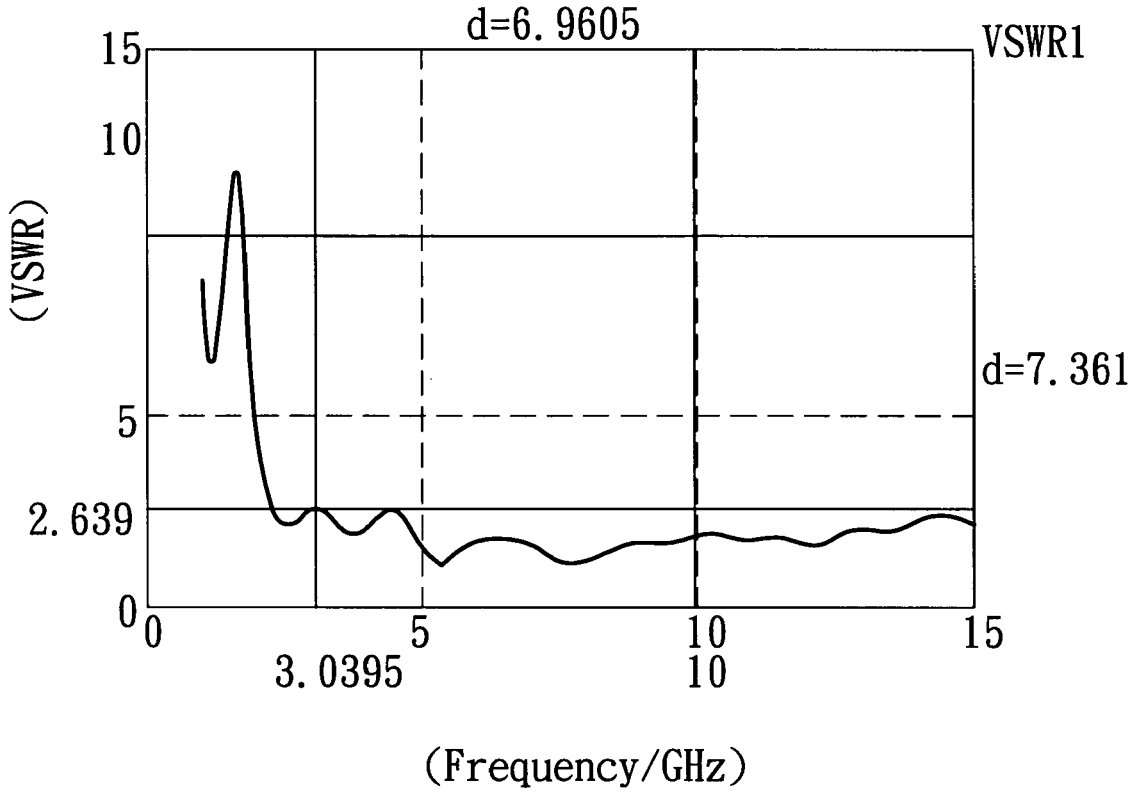
FIG. 7 is a plot of the voltage standing wave ratio (VSWR) of the second preferred embodiment within a range of frequency.

As illustrated in FIG. 7, the planar antenna device 3 of the second preferred embodiment thus formed has a low VSWR, i.e., below 2.639, within a frequency range from 3.1 GHz to 10.6 GHz, and is thus suitable for operating at the ultra wide bandwidth.

Figure 8:
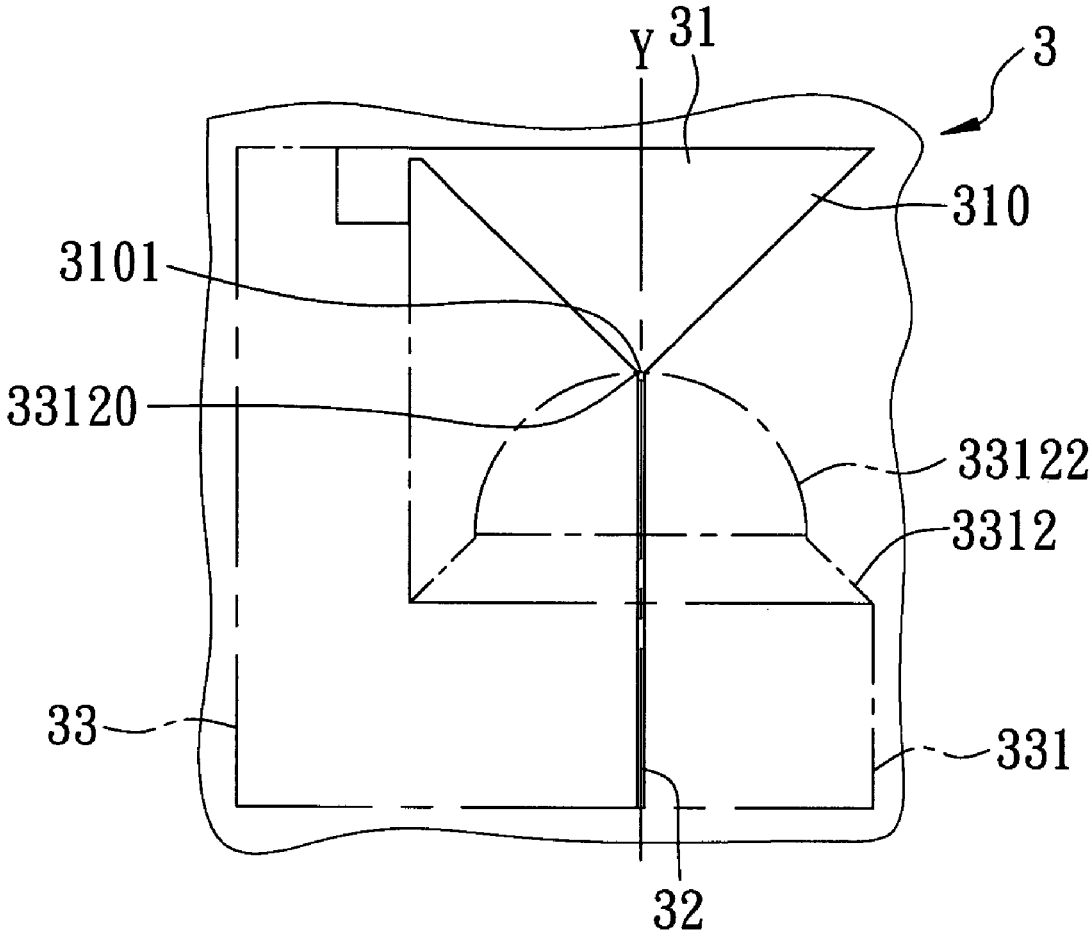
FIG. 8 is a fragmentary schematic view of the third preferred embodiment of an antenna device according to this invention.

FIG. 8 illustrates the third preferred embodiment of the planar antenna device 3 according to this invention. The planar antenna device 3 of this embodiment differs from the first embodiment in that the second section 33122 of the second segment 3312 is semi-circular in shape and passes through the axis (Y).

Figure 9:
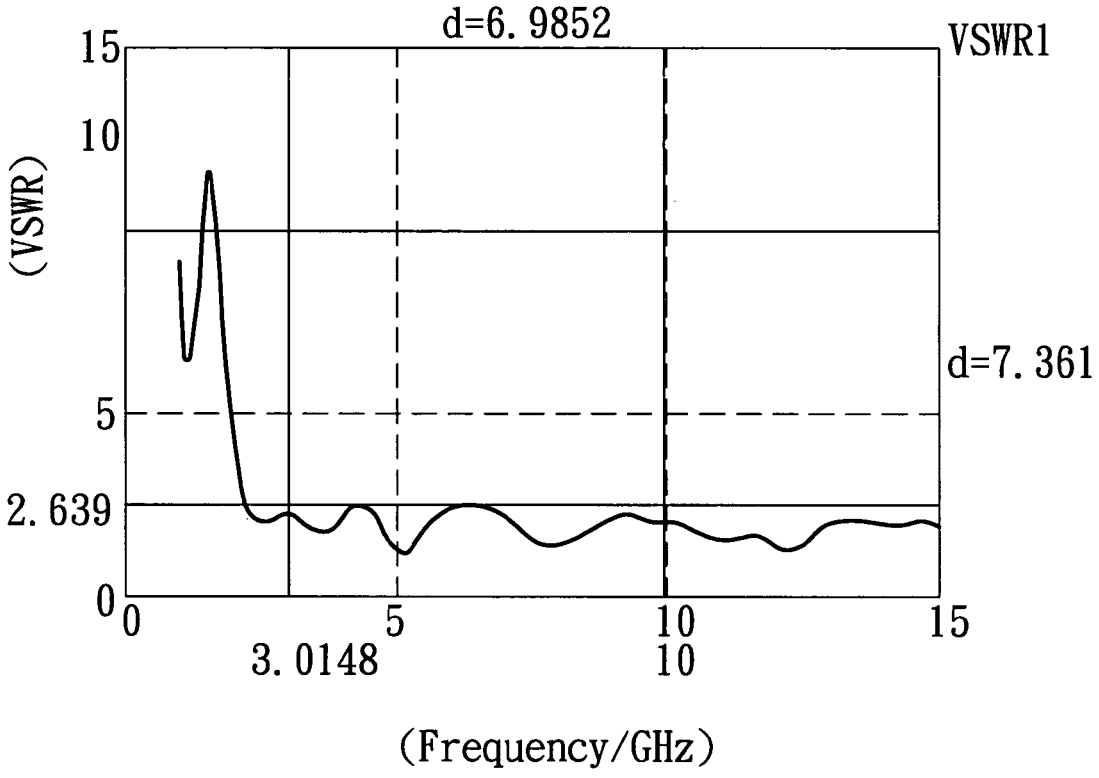
FIG. 9 is a plot of the voltage standing wave ratio (VSWR) of the third preferred embodiment within a range of frequency.

As illustrated in FIG. 9, the planar antenna device 3 of the third preferred embodiment thus formed has a low VSWR, i.e., below 2.639, within a frequency range from 3.1 GHz to 10.6 GHz, and is thus suitable for operating at the ultra wide bandwidth.

By virtue of the shapes and the arrangements of the radiating element 31 and the grounding element 33 of the planar antenna device 3 of this invention, the planar antenna device 3 can be operated at the UWB and achieve a low VSWR, and the aforesaid drawback associated with the prior art can be eliminated.

With the invention thus explained, it is apparent that various modifications and variations can be made without departing from the spirit of the present invention. It is therefore intended that the invention be limited only as recited in the appended claims.

I claim:

1. An antenna device having ultra wide bandwidth characteristics, comprising:

a dielectric substrate having first and second surfaces that are opposite to each other in a normal direction;

a radiating element formed on said first surface of said dielectric substrate, defining an axis perpendicular to said normal direction, and having a peripheral edge that has an inner portion; and a grounding element formed on said second surface of said dielectric substrate and having a peripheral edge that has an inner portion facing toward said inner portion of said peripheral edge of said radiating element;

wherein said inner portion of said peripheral edge of said grounding element cooperates with said inner portion of said peripheral edge of said radiating element to define first and second imaginary slots in said dielectric substrate, said first and second imaginary slots extending in said normal direction from said first surface to said second surface of said dielectric substrate, and being respectively disposed at two opposite sides of said axis.

2. The antenna device of claim 1, wherein said radiating element has a first part that defines a first tip at said inner portion of said peripheral edge of said radiating element, said axis passing through said first tip.

3. The antenna device of claim 2, wherein said first imaginary slot diverges from said first tip in a first direction transverse to said axis, said second imaginary slot diverging from said first tip in a second direction opposite to said first direction.

4. The antenna device of claim 3, wherein said first part of said radiating element is substantially triangular in shape and further defines a second tip, said radiating element further including a second part that is substantially square in shape and that extends from said second tip in a direction parallel to said axis.

5. The antenna device of claim 4, wherein said first part of said radiating element further defines a third tip, and has a first side extending between said first and second tips and confining one side of said first imaginary slot, and a second side extending between said first and third tips and confining one side of said second imaginary slot.

6. The antenna device of claim 5, wherein said grounding element has a first part that extends in a direction parallel to said axis and that has a first end portion aligned with said second part of said radiating element in said normal direction, and a second end portion opposite to said first end portion, said grounding element further including a second part that extends from said second end portion of said first part of said grounding element and that is aligned with said first part of said radiating element along said axis.

7. The antenna device of claim 6, wherein said second part of said grounding element has a first segment extending transversely from said second end portion of said first part of said grounding element and passing through said axis, and a second segment reduced in dimension from said first segment toward said first tip of said first part of said radiating element and having an edge that is aligned with said first tip of said first part of said radiating element in said normal direction, said second segment of said second part of said grounding element cooperating with said first part of said grounding element and said first part of said radiating element to define said first imaginary slot, said second segment of said second part of said grounding element cooperating with said first part of said radiating element to define said second imaginary slot.

8. The antenna device of claim 7, wherein said second segment of said second part of said grounding element has a first section that is reduced in dimension from said first segment and that is trapezoid in shape, and a second section that extends from said first section and that defines said edge of said second segment.

9. The antenna device of claim 8, wherein said second section of said second segment is rectangular in shape and passes through said axis.

10. The antenna device of claim 8, wherein said second section of said second segment is semi-circular in shape and passes through said axis.

11. The antenna device of claim 8, wherein said second section of said second segment has a first portion that is square in shape and that is disposed at one of said sides of said axis, and a second portion that is triangular in shape and that is disposed at the other of said sides of said axis.

12. The antenna device of claim 7, further comprising a feeding element that is formed on said first surface of said dielectric substrate and that extends from said first tip of said radiating element along said axis.

13. The antenna device of claim 12, wherein said first segment of said second part of said grounding element has an outer side that is distal from said second segment of said second part of said grounding element, said feeding element having a terminal end that is aligned with said outer side of said first segment in said normal direction.

14. The antenna device of claim 6, further comprising at least one conductive connecting line that is connected to and that extends from said second part of said radiating element through said dielectric substrate to connect with said first end portion of said first part of said grounding element.

* * * * *